United States Patent [19]

Glaze, Jr. et al.

[11] Patent Number: 4,613,065

[45] Date of Patent: Sep. 23, 1986

[54] METHOD OF HANDLING HOSIERY

[75] Inventors: John W. Glaze, Jr., Charlotte; Ernest E. Cline, Monroe, both of N.C.

[73] Assignee: Intech Corporation, Charlotte, N.C.

[21] Appl. No.: 726,243

[22] Filed: Apr. 23, 1985

[51] Int. Cl.[4] ..... A41H 33/00; D06C 5/00

[52] U.S. Cl. ..... 223/37; 223/75; 223/112

[58] Field of Search ..... 223/37, 38, 75, 76, 223/77, 112

[56] References Cited

U.S. PATENT DOCUMENTS

| | | | |
|---|---|---|---|
| 1,126,619 | 1/1915 | Clouston et al. | 223/112 |
| 2,990,088 | 6/1961 | Isken et al. | 223/76 |
| 3,054,542 | 9/1962 | Glaze, Jr. et al. | 223/112 |
| 3,319,849 | 5/1967 | Hornberg, Jr. | 223/76 |
| 3,685,818 | 8/1972 | Burger | 223/37 X |

OTHER PUBLICATIONS

Intech Corp. brochure; Hosier, Boarding Machine 940H.

Heliot brochure; Sock-Set.

Heliot brochure; Sockpress.

*Primary Examiner*—Louis K. Rimrodt

*Attorney, Agent, or Firm*—Banner, Birch, McKie & Beckett

[57] ABSTRACT

A method of handling hosiery after the hosiery has been stripped from a form is disclosed and comprises the steps of: (a) transferring hosiery one at a time from a stripping mechanism to an accumulating mechanism; (b) vertically suspending the hosiery from the accumulating mechanism; (c) straightening the hosiery by contacting the hosiery, while it is vertically suspended from the accumulating mechanism, with a stroking element and moving the stroking element over a portion of the hosiery's length; (d) accumulating a desired number of hosiery in the accumulating mechanism by performing steps (a), (b) and (c) for the desired number; and (e) transferring the desired number from the accumulator mechanism by releasing the accumulated hosiery from the accumulator mechanism when the stroking element is in contact with the accumulated hosiery intermediate its length so that the accumulated hosiery folds over the stroking element, and moving the stroking element to a hosiery transfer location.

8 Claims, 7 Drawing Figures

METHOD OF HANDLING HOSIERY

TECHNICAL FIELD

The present invention relates to the field of hosiery processing. More particularly, the present invention relates to a method of handling hosiery after the hosiery has been processed on moveable forms.

BACKGROUND OF THE INVENTION

The term hosiery is used herein to generically denote all types of clothing articles intended for wear on feet and legs, such as socks, stockings and pantyhose. After hosiery has been formed into its general intended shape by knitting, weaving or other techniques, it typically undergoes furher processing on moveable forms which carry the hosiery through further processing operations. Once the further processing has been completed, the hosiery must be stripped from the forms and prepared for packaging.

In order to facilitate the storage, handling, inspecting and packaging of hosiery after it has been boarded it is important that the individual garment or garments be wrinkle-free and neatly stacked or folded. Some types of garments, particularly socks that have been accumulated and hung vertically after stripping from boarding forms hang neatly in a vertical side-by-side relationship without special handling. Pantyhose and stockings because of their length, their very light weight and the oft-times presence of static electricity or air movement, do not necessarily hang side-by-side in orderly fashion and may twist, wrinkle or tangle, thereby hindering subsequent handling operations and detracting from the appearance of the finished product.

Gang strippers have sometimes been used in order to suspend garments side-by-side in a space relationship to each other in order to try to overcome these problems. In a gang type stripper a large number of garments are suspended from an accumulator without being straightened by stroking. When groups of garments so suspended are folded from this position by squeezing the suspended garment with bars on either side of the group, the resulting stack is staggered and disarranged by the relative movement of the garments one against the other during the squeeze and fold operation making it difficult to handle the garments in subsequent operations.

The present invention was developed to handle hosiery in a manner which allows subsequent handling to be accomplished in a more efficient manner because the hosiery is transferred from the accumulator in a neatly arranged stack. When the garments have been collated prior to folding, the space between them will have been eliminated with the result that any ensuing fold will result in a neat and tidy stack. The neatness of this fold is further enhanced since before the folding operation the garments are stroked and flattened individually or successively against each other during the collating (accumulating) process.

SUMMARY OF THE INVENTION

The present invention is directed to a method of handling hosiery after the hosiery has been stripped from a form, and comprises the steps of: (a) transferring hosiery one at a time from a stripping mechanism to an accumulating mechanism; (b) vertically suspending the hosiery from the accumulating mechanism; (c) straightening the hosiery by contacting the hosiery, while it is vertically suspended from the accumulating mechanism, with a stroking element and moving the stroking element over a portion of the hosiery's length; (d) accumulating a desired number of hosiery in the accumulating mechanism by performing steps (a), (b) and (c) for the desired number; and (e) transferring the desired number of hosiery from the accumulator mechanism when the stroking element is in contact with the accumulated hosiery intermediate its length so that the accumulated hosiery folds over the stroking element, and moving the stroking element to a hosiery transfer location.

In a preferred embodiment, the stroking element moves through an arcuate path over a major portion of the hosiery's length by rotating an arm about an axis with the one of the stroking elements extending from the arm on either side of the axis. The strokig elements also move the accumulated hosiery suspended vertically from the accumulator mechanism sideward away from the hosiery being stripped from the forms.

Hosiery handled in this manner accumulates in a neat vertically suspended manner to any desired number. Once the hosiery has been accumulated to the desired number, for example, from one to a dozen, it folds neatly over a stroking element and is carried to a transfer station where it is taken off of the stroking element in a neatly folded condition. In this method hosiery being stripped does not entangle with or disarrange the already stripped and accumulated hosiery, since already stripped and accumulated hosiery are moved away from the path of hosiery being stripped. Hosiery handled in this manner thus arrives at a packaging station in a neater, smoother condition than hosiery handled by prior art techniques.

Various advantages and features of novelty which characterize the invention are pointed out with particularity in the claims annexed hereto and forming a part hereof. However, for a better understanding of the invention, its avantages, and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
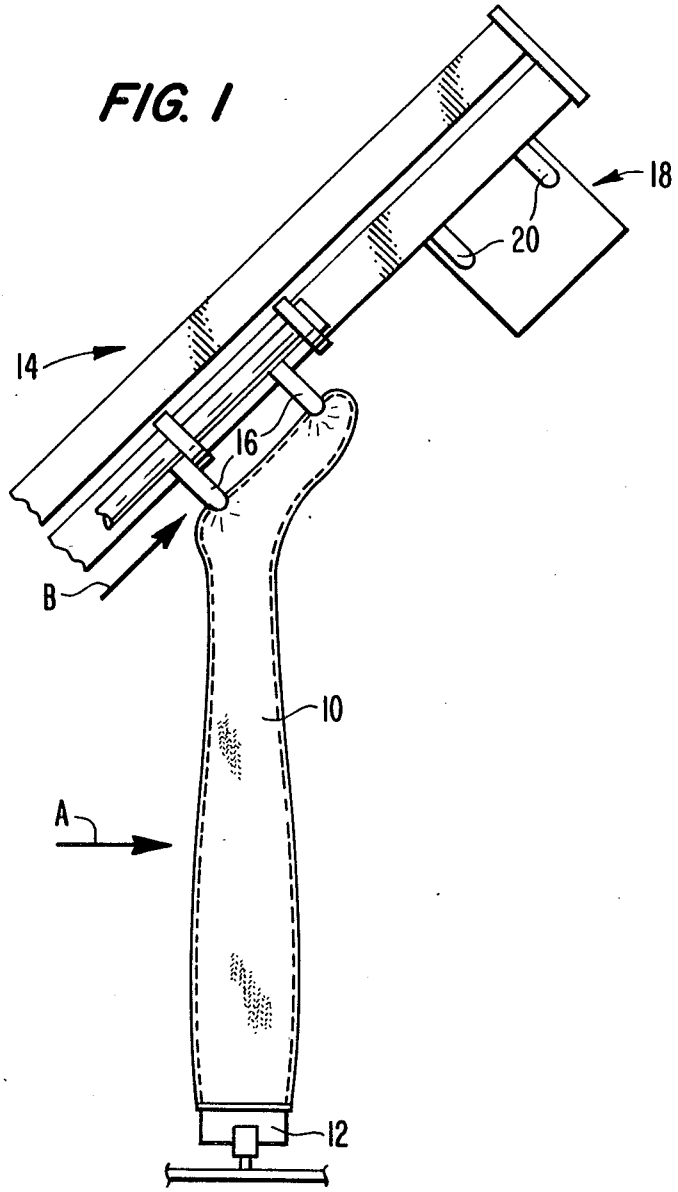
FIG. 1 is a diagrammatic side view of hosiery about to be stripped from a form.

Referring to the drawings, wherein like numerals indicate like elements, the steps of the present method will be illustrated. FIG. 1 illustrates hosiery 10 carried on a form 12 moveable in the direction of arrow A. A stripping mechanism 14 is initiating the process of stripping hosiery 10 from form 12 by grasping the toe and heel portion of hosiery 10 with clips 16 which then move upward at an angle in the direction of arrow B. Clips 16 move upward to a location wherein the hosiery is transferred to accumulator 18 and are held by fingers 20 of accumulator 18. Any desired number of hosiery 10, one or more, can be held by accumulator 18. However, where the hosiery is to be handled in dozens, accumulator 18 would accumulate hosiery 10 in dozen lots. Conventional stripping and accumulating mechanisms, adapted to the particular type of hosiery being handled, can be used.

Figure 2:
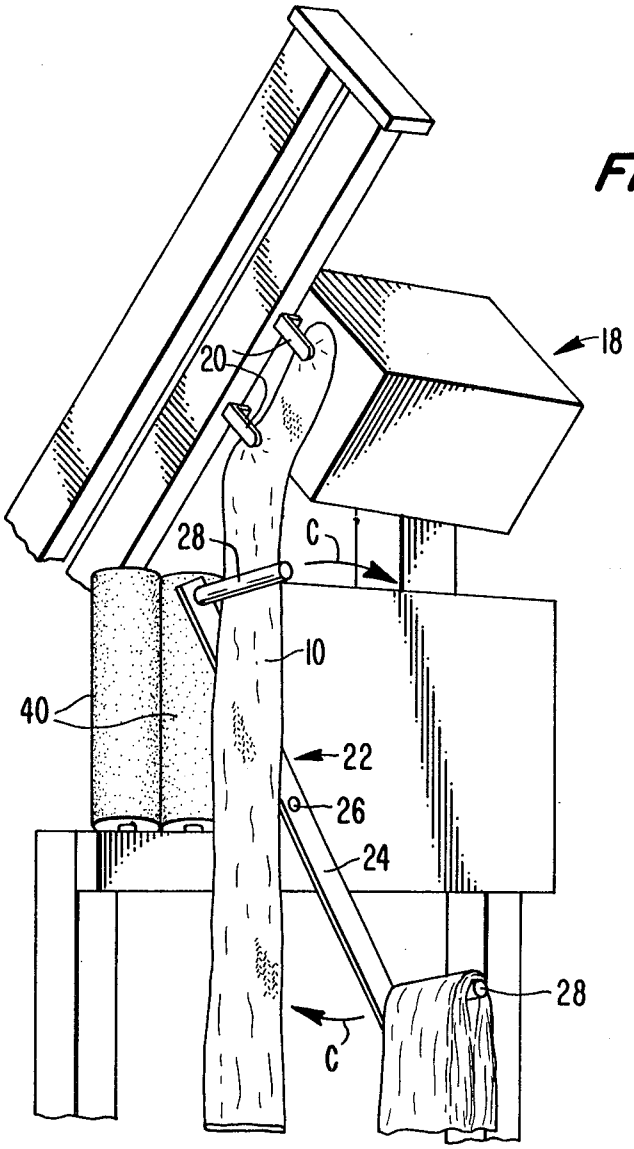
FIGS. 2–7 are diagrammatic perspective views illustrating the steps of the present method.

Turning to FIGS. 2–7, the steps of the method of the present invention are illustrated. In FIG. 2, a first of a desired number of hosiery 10 is illustrated vertically suspended from fingers 20 of accumulator 18. This piece of hosiery 10 has been completely stripped from the form and has partially settled down or relaxed. A stroking mechanism 22 includes an arm 24 rotatable about axis 26 in a clockwise direction illustrated by arrows C. A stroking element 28 extends from an arm 24 on each side of axis 26. Stroking elements 28 thus travel in an arcuate, i.e. circular path. The uppermost stroking element 28 in FIG. 2 is about to contact the vertically suspended hosiery 10 adjacent its heel end, while the lowermost stroking element 28 carries a plurality of hosiery 10 which has been folded over it.

Figure 3:
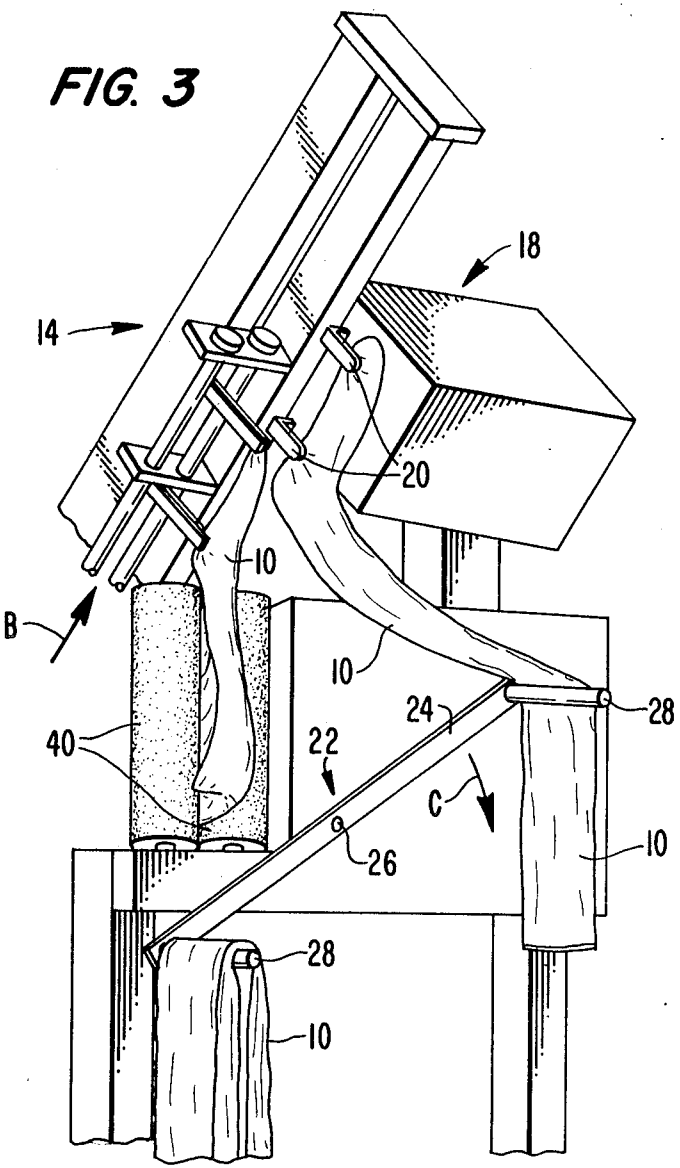

FIG. 3 illustrates the position of stroking elements 28 after arm 24 has rotated approximately 90°. As seen therein, the uppermost stroking element 28 has moved in contact with the single piece of hosiery 10 over a portion of its length, thereby straightening the hosiery, and at the same time, moving the hosiery sidewards away from the path of the next hosiery being stripped by stripping mechanism 14. The next hosiery is illustrated passing through stripping assit rollers 40. Once this hosiery has passed through rollers 40, it will be transferred to accumulator 18. The hosiery folded over the other stroking element 28 will be removed prior to this stroking element coming into contact with the next stripped piece of hosiery. The folded hosiery can be removed anywhere along the arcuate path of the stroking element prior to the stroking element coming into contact with the next stripped piece of hosiery. However, the folded hosiery is preferably removed at the position in FIG. 3, which is a stop position of arm 24. Arm 24 pauses at each half-cycle in this position for two reasons. First, if hosiery is folded over lower stroking element 28, an operator is given adequate time to remove the folded hosiery. Second, once a piece of hosiery has passed through rollers 40 and is suspended from accumulator 18, it is given time to relax and stabilize.

Figure 4:
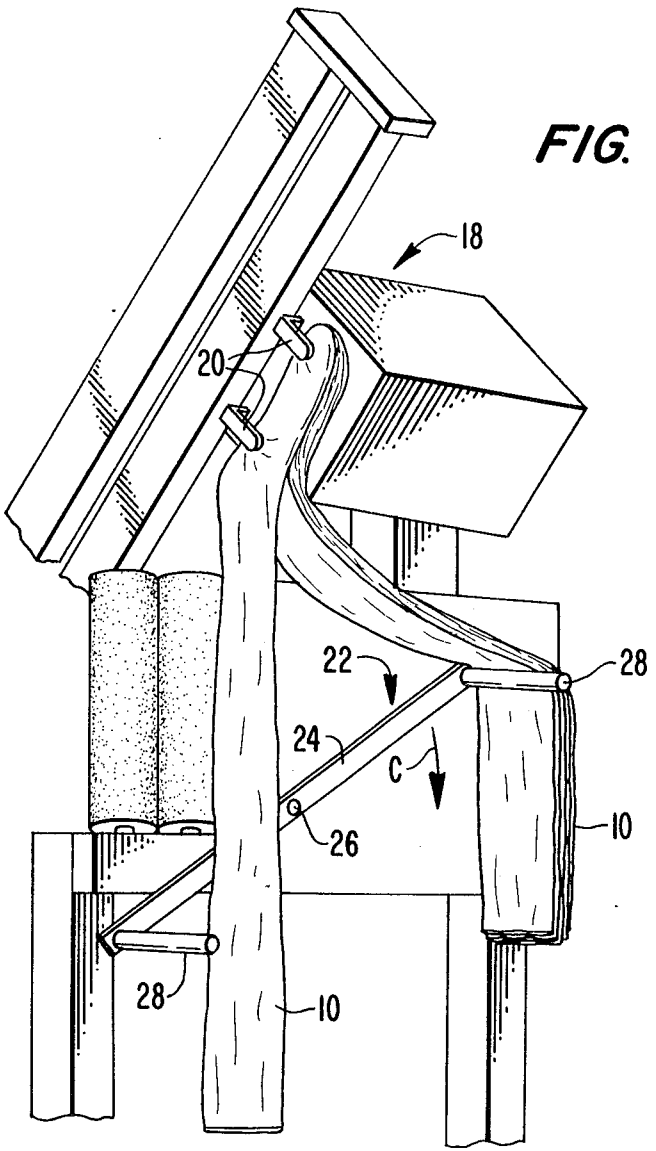

FIG. 4 illustrates stroking elements 28 in approximately the same location as in FIG. 3, but with the folded hosiery removed, and a number of pieces of hosiery 10 vertically suspended from accumulator 18. The previously accumulated hosiery have been stroked along a portion of their length by the uppermost stroking element 28, and the last stripped piece of hosiery is in a vertically suspended position. During the pause of arm 24, the last stripped piece of hosiery at least partially stabilizes. After the pause, the lowermost stroking element moves in an upward arcuate motion to contact and stroke the hosiery.

Figure 5:
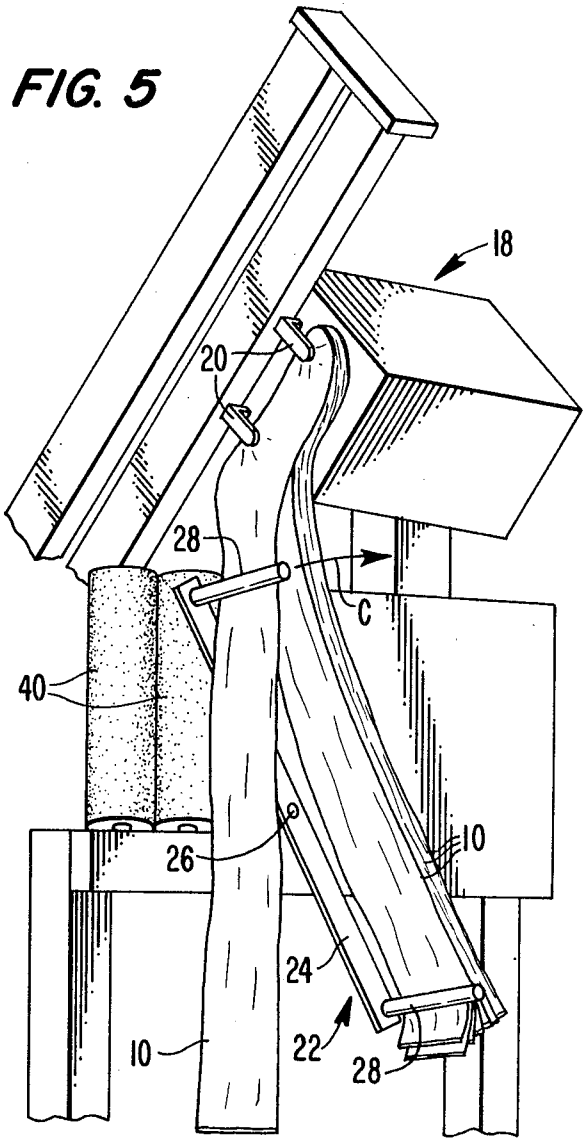
Figure 7:
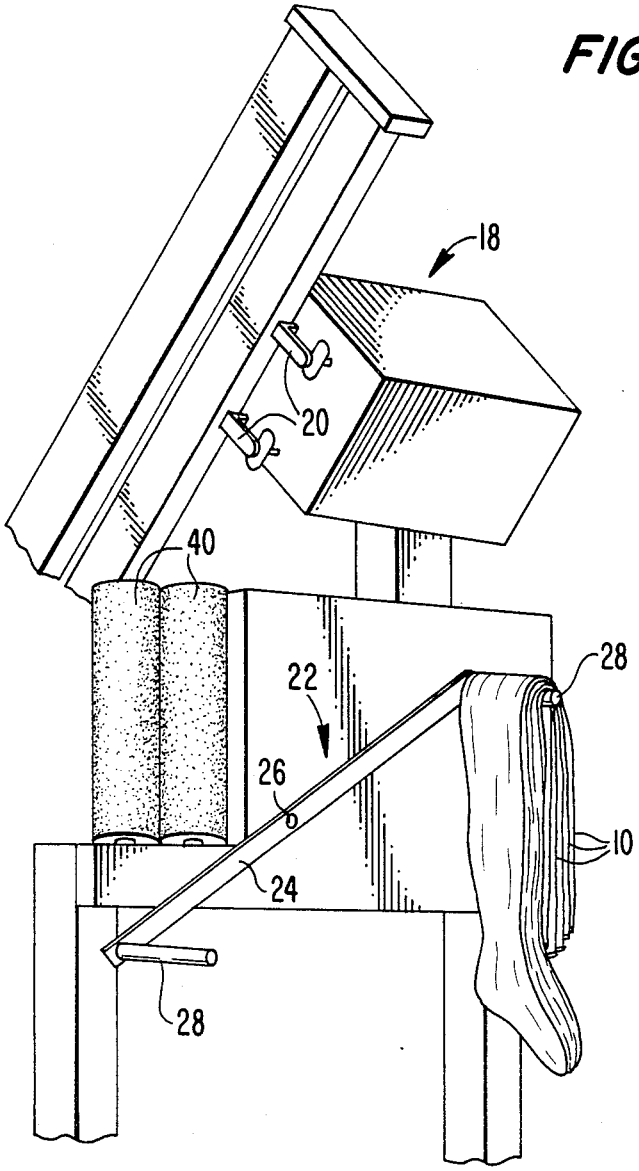

FIG. 5 illustrates stroking elements 28 after arm 24 has rotated approximately 90° from FIG. 4 so that the now uppermost stroking element is about to come into contact with the last stripped piece of hosiery and the now lowermost stroking element has stroked along a major portion of the length of hosiery, i.e. more than 50% of the length of the hosiery, and is about to leave contact with the hosiery.

Figure 6:
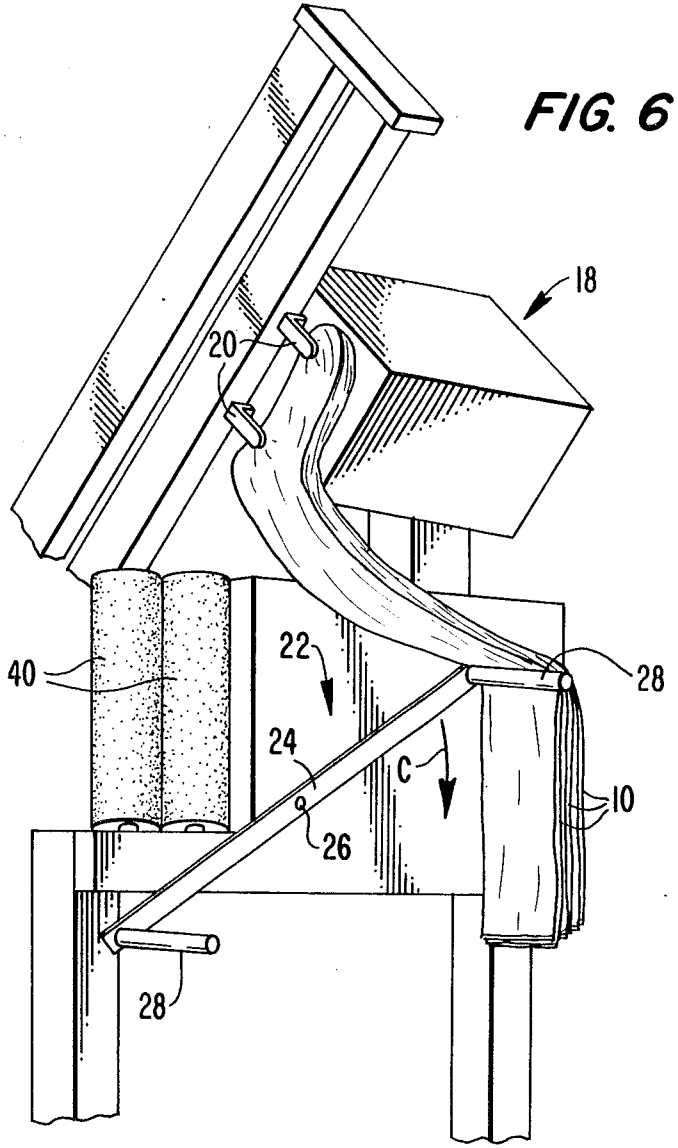

FIG. 6 illustrates stroking elements 28 in a position wherein arm 24 has rotated approximately 90° from its position in FIG. 5. The uppermost stroking element 28 is located intermediate the length of the accumulated hosiery. Since the desired number of hosiery have been accumulated, finger 20 release the heel and toe portions of the accumulated hosiery so that they fold over the uppermost stroking element 28, and assume the position in FIG. 7. Stroking elements 28 are spaced from one another a sufficient distance to permit the accumulated hosiery to freely drop by gravity and fold neatly over one of the stroking elements. The rotating arm 26 continues its motion; the folded hosiery are removed at a hosiery transfer station; and additional hosiery continues to be stripped, accumulated and straightened as described above.

The present method thus straightens hosiery as it is being accumulated in an accumulator; and neatly folds the straightened hosiery over one of the stroking elements, which has been performing the straightening function.

Numerous characteristics and advantages of the invention have been set forth in the foregoing description, together with details of the structure and function of the invention, and the novel features thereof are pointed out in the appended claims. The disclosure, however, is illustrative only, the changes may be made in detail especially in matters of shape, size and arrangement of parts, within the principle of the invention, to the full extent indicated by the broad, general meaning of the terms in which the appended claims are expressed.

We claim:

1. A method of handling hosiery after the hosiery has been stripped from a form comprising the steps of:

(a) transferring hosiery one at a time from a stripping mechanism to an accumulating mechanism;

(b) vertically suspending the hosiery from the accumulating mechanism;

(c) straightening the hosiery by contacting the hosiery, while it is vertically suspended from the accumulating mechanism, with a stroking element and moving the stroking element over a portion of the hosiery's length;

(d) accumulating a desire member of hosiery in the accumulator mechanism by performing steps (a), (b) and (c) for the desired number;

(e) transfering the desired number of hosiery from the accumulator mechanism by:

(i) releasing the accumulated hosiery from the accumulator mechanism when the stroking element is in contact with the accumulated hosiery intermediate its length so that the accumulated hosiery folds over the stroking element; and (ii) moving the stroking element to a hosiery transfer location.

2. A method in accordance with claim 1 wherein the stroking element is moved in contact with the hosiery over a major portion of the hosiery's length.

3. A method in accordance with claim 1 wherein the stroking element moves accumulated hosiery suspended vertically from the accumulator mechanism sideward away from hosiery being stripped from forms.

4. A method in accordance with claim 1 wherein the stroking element moves in an arcuate path during its stroking motion in contact with the hosiery.

5. A method in accordance with claim 4 wherein the stroking element moves in an arcuate path during its transfering motion carrying accumulated hosiery to the transfer location.

6. A method in accordance with claim 5 wherein steps (c) and (e) included rotating an arm about an axis with one of the stroking elements extending from a portion of the arm on each side of the axis.

7. A method in accordance with claim 1 wherein step (c) includes momentarily stopping the motion of said stroking element to allow the suspended hosiery to at least partially stabilize.

8. A method of handling hosiery after the hosiery has been stripped from a form comprising the steps of:

(a) transfering hosiery one at a time from a stripping mechanism to an accumulating mechanism;

(b) vertically suspending the hosiery from the accumulating mechanism;

(c) straightening the hosiery by contacting the hosiery, while it is vertically suspended from the accumulating mechanism, with a stroking element and moving the stroking element through an arcuate path over a major portion of the hosiery's length by rotating an arm about an axis with one of the stroking elements extending from the arm on either side of the axis;

(d) moving with the stroking element the accumulated hosiery suspended vertically from the acumulator mechanism sideward away from hosiery being stripped from forms;

(e) accumulating a desired number of hosiery in the accumulator mechanism by performing steps (a), (b) and (c) for the desired number;

(f) transfering the desired number of hosiery from the accumulator mechanism by:

(i) releasing the accumulated hosiery from the accumulator mechanism when the stroking element is in contact with the accumulated hosiery intermediate its length so that the accumulated hosiery folds over the stroking element; and (ii) moving the stroking element to a hosiery transfer location.

* * * * *